US005994285A

United States Patent [19]

Sachdev et al.

[11] Patent Number: 5,994,285

[45] Date of Patent: Nov. 30, 1999

[54] LIQUID LAUNDRY DETERGENT COMPOSITION CONTAINING ETHOXYLATED AMINE QUATERNARY SURFACTANT

[75] Inventors: Amit Sachdev, Scotch Plains; Suzanne M. Jogun, Lincoln Park, both of N.J.

[73] Assignee: Colgate-Palmolive Co., New York, N.Y.

[21] Appl. No.: 09/332,773

[22] Filed: Jun. 14, 1999

[51] Int. Cl.[6] ..... C11D 1/22; C11D 1/62; C11D 7/12; C11D 7/16

[52] U.S. Cl. ..... 510/329; 510/276; 510/322; 510/330; 510/352; 510/357; 510/359; 510/426; 510/428; 510/478; 510/504; 510/509; 510/510

[58] Field of Search ..... 510/276, 322, 510/329, 330, 352, 357, 359, 426, 428, 478, 504, 509, 510

[56] References Cited

U.S. PATENT DOCUMENTS

| | | | |
|---|---|---|---|
| 4,234,465 | 11/1980 | Magari et al. | 252/547 |
| 4,770,815 | 9/1988 | Baker et al. | 252/542 |
| 5,602,092 | 2/1997 | Repinec, Jr. et al. | 510/434 |
| 5,730,760 | 3/1998 | Kirk et al. | 8/137 |

*Primary Examiner*—Yogendra Gupta
*Assistant Examiner*—Charles Boyer
*Attorney, Agent, or Firm*—Bernard Lieberman

[57] ABSTRACT

A stable structured liquid laundry detergent composition is provided which is particularly effective for removing oily soils from fabrics. The detergent composition comprises, by weight:

(a) from about 10% to about 20% of a linear alkyl benzene sulfonate anionic surfactant;

(b) from about 0% to about 10% of an alkyl ether sulfate anionic surfactant;

(c) from about 5% to about 30% of an alkali metal phosphorous-containing builder;

(d) from about 2% to about 15% of sodium carbonate; the total amount of components (c) plus (d) in the detergent composition being at least about 10%;

(e) from about 0.1% to about 5% of an ethoxylated amine quaternary cationic surfactant having the following structural formula:

(1)

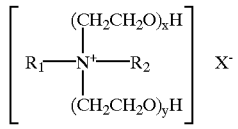

wherein $R_1$ represents a linear branched or substituted $C_8$–$C_{18}$ alkyl, alkaryl, aryl, alkenyl or ether moiety; $R_2$ represents an alkyl group containing from 1 to 3 carbon atoms or a benzyl group; each of x and y are integers which can vary independently from 1 to 8 and the sum of x plus y is greater than 2 and less than 9; and X represents a water-soluble anion; and (f) balance water, said structured liquid detergent composition being free of a nonionic surfactant, and wherein the respective amounts of each of the components (a) through (e) is selected to provide a stable structured liquid composition.

9 Claims, No Drawings

LIQUID LAUNDRY DETERGENT COMPOSITION CONTAINING ETHOXYLATED AMINE QUATERNARY SURFACTANT

FIELD OF THE INVENTION

The present invention relates to structured liquid laundry detergent compositions which are particularly effective for removing oily soils and stains from fabrics. More particularly, the present invention relates to the formulation and use of structured liquid laundry detergent compositions containing a synergistic mixture of an anionic surfactant and an ethoxylated amine quaternary cationic surfactant as herein defined.

BACKGROUND OF THE INVENTION

Heavy duty liquid laundry detergents have achieved increasing consumer acceptance in recent years as convenient alternatives to conventional powder laundry detergent compositions. Liquid detergent products generally provide the consumer with a more concentrated and compact commercial detergent product relative to powder products and also allow for ease of operation with respect to targeting the removal of specific stains on fabrics, such as by a pre-spotting or pre-soak step prior to laundering the soiled fabrics in a home washing machine.

In order to achieve efficient laundering of fabrics, laundry detergent compositions are generally formulated to contain a variety of active ingredients, typically one or more anionic surfactants, often in combination with a nonionic surfactant, detergent builder materials such as alkali metal carbonates and zeolites, electrolytes and adjuvants such as brighteners, perfumes and colorants, all of which in the case of a liquid composition must be dispersed or dissolved in an aqueous medium. Because of the relatively limited solubility of this combination of ingredients in water, and the resultant tendency to form a thick, difficult to pour liquid often characterized by phase separation, the principal problems to be overcome in formulating a commercially desirable liquid detergent product are primarily stability and pourability, particularly for liquid products containing high levels of surfactants and builders.

Structured liquid detergent products have received much attention in the laundry detergent art as a means of providing liquid detergent compositions which are capable of suspending undissolved particles while remaining pourable and otherwise having acceptable rheological properties such as phase stability upon storage at ambient and at elevated temperatures. These structured liquids typically contain between 10% and 20%, by weight, of surfactants and from 10% to 25%, by weight, of detergent builder. The challenge in formulating this type of structured liquid is to prevent separation of the liquid into two or more layers while maintaining the viscosity at a pourable level which is commercially acceptable based on the preferences and requirements of the consumer.

The dispersed structuring phase in a structured liquid composition is believed to consist of an onion-like configuration wherein water or the aqueous phase is trapped between concentric layers of detergent active materials. These configurations are often referred to as lamellar droplets or micelles, and it is believed that it is the presence of such lamellar droplets dispersed in the aqueous phase which renders the liquid capable of suspending particulate solid materials, notably insoluble detergent builders, in the liquid product. The invention which is herein described refers to structured liquid detergent compositions which are exemplified by configurations of this type.

Cationic surfactants are extensively described in the patent literature as useful components of heavy duty liquid detergent compositions. But in practice, most commercial non-softening laundry products intended for home-use do not contain this type of surfactant, and instead, are predominantly comprised of a conventional sulfated or sulfonated anionic surfactant and/or a conventional ethoxylated nonionic surfactant primarily because of economic considerations. Moreover, there exists a general notion that anionic and cationic surfactants can not be used in the same composition without suffering a loss of efficacy due to the interaction of the positively charged cationic with the negatively charged anionic in the wash bath. Consequently, anionic and nonionic surfactants remain the "workhorse" surfactants in the majority of commercial liquid laundry detergent cleaning products.

Mixtures of anionic and cationic surfactants have been described in the literature as being useful for laundering compositions. U.S. Pat. No. 5,441,541 to Mehreteab et al describes certain complexes of anionic and cationic surfactants which are found to provide improved removal of oily stains from fabrics. More recently, a series of published PCT applications filed in the name of Procter & Gamble Company have focused attention on detergent compositions containing a bis-alkoxylated quaternary ammonium surfactant in combination with an anionic surfactant and a third component selected from among a soil dispersant polymer; a bleach material; a percarbonate bleach; and an enzyme among other additives useful for cleaning. Included among these published applications are the following: WO 97/44418; WO 97/44419; WO 97/44425; WO 97/44431; WO 97/44432; WO 97/43364; WO 97/43365 and WO 97/43371. The compositions described in these PCT publications do not refer to or otherwise contemplate being able to formulate such compositions in the form of a structured liquid.

Accordingly, there remains a need in the prior art for structured liquid laundry compositions capable of incorporating high levels of a mixed surfactant system of anionic and cationic surfactants in the presence of high levels of detergent builders and which have the capacity to efficiently clean oily soils and stains from fabrics. Further, there remains the need to provide structured liquid compositions which manifest a high degree of phase stability, and the requisite rheological properties to satisfy the commercial requirements for an effective liquid laundry detergent product.

SUMMARY OF THE INVENTION

In accordance with the present invention, there is provided a stable structured liquid laundry detergent composition which is particularly effective for removing oily soils from fabrics comprising, by weight:

(a) from about 10% to about 20% of a linear alkyl benzene sulfonate anionic surfactant;

(b) from about 0% to about 10% of an alkyl ether sulfate anionic surfactant;

(c) from about 5% to about 30% of an alkali metal phosphorous-containing builder;

(d) from about 2% to about 15% of sodium carbonate; the total amount of components (c) plus (d) in the detergent composition being at least about 10%;

(e) from about 0.1% to about 5% of an ethoxylated amine quaternary cationic surfactant having the following structural formula:

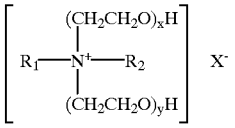

(1)

wherein $R_1$ represents a linear, branched or substituted $C_8$–$C_{18}$ alkyl, alkaryl, aryl, alkenyl or ether moiety; $R_2$ represents an alkyl group containing from 1 to 3 carbon atoms or a benzyl group; each of x and y are integers which can vary independently from 1 to 8 and the sum of x plus y is greater than 2 and less than 9; and X represents a water-soluble anion; and (f) balance water, said structured liquid detergent composition being free of a nonionic surfactant, and wherein the respective amounts of each of the components (a) through (e) is selected to provide a stable structured liquid composition.

In accordance with another aspect of the invention, there is provided a method for washing laundry and removing oily soils from stained fabrics comprising the step of forming a dilute aqueous solution of the liquid laundry detergent composition described above and then subjecting the fabrics to be laundered to a washing action in said dilute aqueous solution.

The present invention is predicated on the discovery that stable structured liquid detergents can be formulated within the region of a phase diagram defined by the ranges of sodium tripolyphosphate and carbonate detergent builder and the defined ranges of surfactant mixture comprised of one or more anionic surfactants in combination with an ethoxylated amine quatemary cationic surfactant. In addition, it has been discovered that, such anionic/cationic surfactant mixture enhances the removal of oily soils and stains from fabric in the wash liquor relative to the efficacy of a liquid detergent comparable thereto containing the same total amount of surfactant and builder, but which does not specifically contain an ethoxylated amine quaternary cationic surfactant in contrast to the liquid compositions of the present invention.

The precise range of compositions which provide the stable structured liquids of the invention is readily determined by those skilled-in-the-art by "mapping" of the phase diagram for the selected anionic surfactant, detergent builder and the ethoxylated amine quaternary cationic surfactant in accordance with the description herein. The mapping process involves the preparation of a series of compositions which cover the range of concentrations of interest for each of the components of the detergent composition. The resulting phase or phases of each composition is noted thereby allowing the region of stable structured liquids and two-phase compositions to be identified for the particular phase diagram of interest.

DETAILED DESCRIPTION OF THE INVENTION

The structured liquid compositions of the invention are able to provide effective laundering of oily soils and stains from fabrics. One of the key ingredients which provides a synergistic interaction with the anionic surfactant(s) present in the composition is the ethoxylated amine quaternary cationic surfactant having a structural formula as shown in formula (1). Referring to the structural formula, in a preferred embodiment R represents a $C_{11}$ to $C_{17}$ alkyl moiety; x and y have values of 5; and $X^-$ represents chloride anion. The cationic surfactant is present in an amount from about 0.1% to about 5%, by weight, and preferably from about 0.1% to about 3%, and most preferably from about 0.5% to about 3%, by weight.

The detergent composition contains from about 10% to about 20% of a linear alkyl benzene sulfonate anionic surfactant wherein the alkyl radical contains from about 10 to 16 carbon atoms in a straight or branched chain and preferably 12 to 15 carbon atoms. Examples of suitable synthetic anionic surfactants are sodium and potassium alkyl ($C_4$–$C_{20}$) benzene sulfonates, particularly sodium linear secondary alkyl ($C_{10}$–$C_{15}$) benzene sulfonates.

Other suitable anionic detergents which are optionally included in the present liquid detergent compositions are the sulfated ethoxylated higher fatty alcohols of the formula $RO(C_2H_4O)_mSO_3M$, wherein R is a fatty alkyl of from 10 to 18 carbon atoms, m is from 2 to 6 (preferably having a value from about ⅕ to ½ the number of carbon atoms in R) and M is a solubilizing salt-forming cation, such as an alkali metal, ammonium, or a higher alkyl benzene sulfonate wherein the higher alkyl is of 10 to 15 carbon atoms. The proportion of ethylene oxide in the polyethoxylated higher alkanol sulfate is generally from 1 to 11 ethylene oxide groups and preferably 2 to 5 moles of ethylene oxide groups per mole of anionic detergent, with three moles being most preferred, especially when the higher alkanol is of 11 to 15 carbon atoms.

The most highly preferred water-soluble anionic detergent compounds are the ammonium and substituted ammonium (such as mono, di and tri ethanolamine), alkali metal (such as, sodium and potassium) and alkaline earth metal (such as, calcium and magnesium) salts of the higher alkyl benzene sulfonates, and higher alkyl sulfates.

The compositions of the invention are preferably free of a nonionic surfactant for purposes of enhancing the stability of the structured liquids.

Builder materials are essential components of the liquid detergent compositions of the present invention. In particular, from about 2% to about 15% of an alkali metal carbonate, such as sodium carbonate, and preferably from about 3% to about 10%, by weight.

A phosphate builder, and in particular an alkali metal (sodium) polyphosphate in an amount of from about 5% to about 30%, by weight, is an integral component of the present liquid detergent compositions. The amount of such polyphosphate builder is preferably from about 8% to about 20%.

Examples of suitable phosphorous-containing inorganic detergency builders include the water-soluble salts, especially alkali metalpyrophosphates, orthophosphates, and polyphosphates. Specific examples of inorganic phosphate builders include sodium and potasium tripolyphosphates, phosphates and hexametaphosphates.

Zeolite A-type aluminosilicate builder, usually hydrated, may optionally be included in the compositions of the invention. Hydrated zeolites X and Y may be useful too, as may be naturally occurring zeolites that can act as detergent builders. Of the various zeolite A products, zeolite 4A, a type of zeolite molecule wherein the pore size is about 4 Angstroms, is often preferred. This type of zeolite is well known in the art and methods for its manufacture are described in the art such as in U.S. Pat. No. 3,114,603.

The zeolite builders are generally of the formula $$(Na_2O)_x.(Al_2O_3)_y.(SiO_2)_z.w\ H_2O$$

wherein x is 1, y is from 0.8 to 1.2, preferably about 1, z is from 1.5 to 3.5, preferably 2 or 3 or about 2, and w is from 0 to 9, preferably 2.5 to 6. The crystalline types of zeolite which may be employed herein include those described in "Zeolite Molecular Series" by Donald Breck, published in 1974 by John Wiley & Sons, typical commercially available zeolites being listed in Table 9.6 at pages 747–749 of the text, such Table being incorporated herein by reference.

The zeolite builder should be a univalent cation exchanging zeolite, i.e., it should be aluminosilicate of a univalent cation such as sodium, potassium, lithium (when practicable) or other alkali metal, or ammonium. A zeolite having an alkali metal cation, especially sodium, is most preferred, as is indicated in the formula shown above. The zeolites employed may be characterized as having a high exchange capacity for calcium ion, which is normally from about 200 to 400 or more milligram equivalents of calcium carbonate hardness per gram of the aluminosilicate, preferably 250 to 350 mg. eg./g., on an anhydrous zeolite basis. A preferred amount of zeolite is from about 8% to about 20%

Other components may be present in the detergent compositions to improve the properties and in some cases, to act as diluents or fillers. Illustrative of suitable adjuvants are enzymes to further promote cleaning of certain hard to remove stains from laundry or hard surfaces. Among enzymes, the proteolytic and amylolytic enzymes are most useful. Other useful adjuvants are foaming agents, such as lauric myristic diethanolamide, when foam is desired, and anti-foams, when desired, such as dimethyl silicone fluids. Also useful are polymers, anti-redeposition agents, bleaches, fluorescent brighteners, such as stilbene brighteners, colorants such as dyes and pigments and perfume.

For efficient laundering and removal of oily soils from fabrics, the dosage of the structured liquid detergent composition is generally from about 1 gram/liter to about 2.5 gram/liter.

EXAMPLES

In the following Examples the surfactants tested included an ethoxylated quat; several ethoxylated ether quats, and a nonionic surfactant as described below.

| Surfactant | Acronym | Description |
|---|---|---|
| 1. Lauryl amine dimethyl benzyl chloride quat | Q | Unexthoylated quat<br>$R_1$ = lauryl<br>$R_2$ = benzyl |
| 2. Lauryl amine ethoxylate (5EO) benzyl chloride quat | E-Q (5EO) | Ethoxylated quat<br>$R_1$ = $C_{12}$—$C_{14}$ linear alkyl group (lauryl)<br>$R_2$ = benzyl<br>x + y = 5 (5EO) |
| 3. Isodecycloxypropyl poly(5) oxyethylene methyl chloride quat [Iso $C_{10}$ oxypropyl] | EE14-Q (5EO) | Ethoxylated ether quat<br>$R_1$ = Isodecycloxypropyl<br>$R_2$ = methyl<br>x + y = 5 (5EO) |
| 4. Isodecycloxypropyl hydroxyethylene methyl chloride quat [Iso $C_{10}$ oxypropyl] | EE14-Q (2EO) | Ethoxylated ether quat<br>$R_1$ = Isodecycloxypropyl<br>$R_2$ = methyl<br>x + y = 2 (2EO) |
| 5. Isotridecyloxypropyl poly(5) oxyethylene methyl chloride quat [Iso $C_{13}$ oxypropyl] | EE17-Q (5EO) | Ethoxylated ether quat<br>$R_1$ = Isotricycloxypropyl<br>$R_2$ = methyl<br>x + y = 5 (5EO) |

-continued

| Surfactant | Acronym | Description |
|---|---|---|
| 6. Isotridecyloxypropyl hydroxyethylene methyl chloride quat [Iso $C_{13}$ oxypropyl) | EE17-Q (2EO) | Ethoxylated ether quat<br>$R_1$ = Isotridecyloxypropyl<br>$R_2$ = Methyl<br>x + y = 2(2EO) |
| 7. $C_{12}$—$C_{14}$ Alcohol poly (7 mole) ethoxylate | L24-7 | Nonionic surfactant |

Example 1

The following experiment was conducted to determine the effect of ethoxylation in a quat surfactant with regard to the stability of the structured liquid containing such surfactant.

Compositions A, B and C were formulated as shown in Table I.

TABLE I

| Component | Compositions (wt. %) A | B | C |
|---|---|---|---|
| LAS(1) | 12 | 12 | 12 |
| AEOS(2) | 1.0 | 1.0 | 1.0 |
| STPP(3) | 8 | 8 | 8 |
| Carbonate | 6 | 6 | 6 |
| Q | 2.0 | — | — |
| EE14-Q (5EO) | — | — | 2.0 |
| EE17-Q (2EO) | — | 2.0 | — |
| Stability | Separated after 1 day | Separated after 3 days | Stable(4) |

(1)an anionic surfactant which is linear alkyl benzene sulfonate
(2)an anionic surfactant which is an ethoxylated alkyl ether sulfate
(3)sodium tripolyphosphate
(4)"stable" refers to stability for at least one month at room temperature Composition A, a structured liquid containing unethoxylated quat was unstable; the liquid phase separated in less than one day. Composition B (outside the invention) contained an ethoxylated quat with an ethoxylation degree of only 2 ($R_1$=isotridecycloxypropyl; x+y=2). Although composition B was somewhat more stable than A, it too destabilized in a few days.

Composition C remained in the form of a stable structured liquid. It contained an ethoxylated quat surfactant with 5 moles of ethoxylation, a quat surfactant within the present invention.

Example 2

The purpose of this example was to demonstrate the stability of structured liquids containing an ethoxylated quat or an ethoxylated ether quat in accordance with the invention versus the use of a nonionic surfactant which is effective for stain removal.

Compositions I through O were formulated as shown in Table II below, and were allowed to stand at room temperature for more than 4 weeks to evaluate stability.

TABLE II

| Component | Compositions (wt. %) I | J | K | L | M | N | O |
|---|---|---|---|---|---|---|---|
| LAS | 12.5 | 12.5 | 12.5 | 12.5 | 9.1 | 10.52 | 12.5 |
| AEOS | 2.5 | 2.5 | 0.0 | 0.0 | 2.5 | 2.5 | 1.14 |
| STPP | 15.0 | 15.0 | 15.0 | 15.0 | 15.0 | 15.0 | 15.0 |
| Carbonate | 6.0 | 6.0 | 6.0 | 6.0 | 6.0 | 6.0 | 6.0 |
| Q | — | — | — | — | — | — | — |
| E-Q | — | — | — | — | — | — | 0.75 |
| EE 14-Q (5EO) | — | 2.0 | — | 2.5 | 6.0 | 0.4 | — |
| Alcohol Ethoxylate (L24-7) | 2.0 | — | 2.5 | — | — | — | — |
| Stability | Separated after 4 wks. | Stable | Separated in 3 days | Stable | Stable | Stable | Stable |

As shown in the Table, Compositions J, L, M, N and O in accordance with the invention were all physically stable for at least one month at room temperature. The substitution of a nonionic surfactant in place of an ethoxylated quat or ethoxylated ether quat (Compositions I and K) destabilized the liquid composition.

Example 3

The purpose of this Example was to measure the effect on detergency when using two structured liquid detergent compositions in accordance with the invention versus the use of two comparative structured liquid detergents which are outside the invention.

Compositions S, T and U were formulated as shown in Table III below. Compositions S1 and S2 are comparative compositions outside the invention.

TABLE III

| Component | Compositions (wt. %) S1 | S2 | T | U |
|---|---|---|---|---|
| LAS | 12.5 | 12.5 | 12.5 | 12.5 |
| AEOS | 2.5 | 2.5 | 2.5 | 0.0 |
| STPP | 15.0 | 15.0 | 15.0 | 15.0 |
| Sodium Carbonate | 6.0 | 6.0 | 6.0 | 6.0 |
| Carboxymethyl cellulose | 0.11 | 0.11 | 0.11 | 0.11 |
| Preservative | 0.2 | 0.2 | 0.2 | 0.2 |
| Water | QS | QS | QS | QS |
| E-Q | — | — | 2.0 | — |
| EE 14-Q (5EO) | — | — | — | 2.0 |
| Alcohol Ethoxylate (L24-7) | — | 2.0 | — | — |

The detergency testing was performed in a top loading washing machine (Maytag, 64 liter capacity) with a 10 minute wash cycle and a 5 minute rinse. The initial water temperature was 77° F. and the hardness ion concentration was maintained at 50 ppm. The dosage of each composition in the wash water was 1.4 gram/liter.

Fabric swatches stained with representative oily/greasy soils were used to measure the extent of cleaning. The prestained swatches used in all of the testing were taken from the same lot thereby ensuring a level of consistency. The results as measured by a reflectomer are expressed in L* reflectance units (from the HunterLab L*, a*, b* scale). A higher L* value represents better stain removal. A difference of 5 units is considered statistically significant.

TABLE IV

Oily Stain Detergent Results

| Stain/Soil | Fabric | Average L* S1 | S2 | U | T |
|---|---|---|---|---|---|
| Liquid Makeup | 65/35 D/C | 77.53 | 78.98 | 77.56 | 80.07 |
| Sebum + Partic. | 65/35 D/C Poplin | 82.07 | 83.64 | 85.42 | 83.78 |
| Sebum + Partic. | Dacron Dknit | 71.00 | 70.58 | 70.34 | 73.36 |
| Barbecue Sauce | Dacron Dknit | 83.28 | 83.61 | 87.52 | 88.24 |
| Barbecue Sauce | Poplin D65/C35 | 89.58 | 89.91 | 92.35 | 91.93 |
| French Dressing | Dacron Dknit | 80.24 | 79.31 | 83.40 | 79.85 |
| Olive Oil | Poplin D65/C35 | 87.49 | 87.73 | 90.03 | 91.66 |
| Motor Oil | Poplin D65/C35 | 74.04 | 74.91 | 75.01 | 73.88 |
| Lard | Poplin D65/C35 | 79.87 | 78.00 | 81.24 | 79.70 |
| Chicken Fat | Cotton Percale | 79.54 | 79.49 | 81.13 | 85.33 |
| Total L* | | 804.65 | 806.16 | 823.98 | 827.78 |

As shown in Table IV, S1 and S2, the comparative compositions, provided nearly equivalent detergency results despite the fact that S2 contained 2% more of an LAS anionic surfactant. Composition U of the invention which contained 2% ethoxylated (5EO) ether quat provided significantly improved stain removal relative to both S1 and S2. Similarly, composition T of the invention which contained 2% ethoxylated (5EO) quat, provided significantly improved stain removal relative to that provided by S1 and S2.

Example 4

The purpose of this experiment was to compare the detergency of a liquid composition containing an ethoxylated ether quat not in accordance with the invention (Composition V) versus comparative Composition S1 previously described in Example 3. Composition V is described below.

| Component | Compositions (wt. %) V |
|---|---|
| LAS | 12.5 |
| AEOS | 2.5 |

-continued

| Component | Compositions (wt. %) V |
|---|---|
| STPP | 15.0 |
| Sodium Carbonate | 6.0 |
| Carboxymethyl cellulose | 0.11 |
| Preservative | 0.2 |
| Water | QS |
| EE17-Q (2EO) | 2.0 |

The oily stain detergency testing was conducted as described above in Example 3. The results expressed in L* reflectance units are shown in Table V.

TABLE V

Oil Stain Detergency

| Stain/Soil | Fabric | Composition wt. % S1 | V |
|---|---|---|---|
| Liquid Makeup | 65/35 D/C | 73.07 | 69.69 |
| Sebum + Partic. | 65/35 D/C Poplin | 81.84 | 79.01 |
| Sebum + Partic. | Dacron Dknit | 78.17 | 73.19 |
| Barbecue Sauce | Dacron Dknit | 80.92 | 79.01 |
| Barbecue Sauce | Poplin D65/C35 | 85.47 | 84.03 |
| French Dressing | Dacron Dknit | 81.27 | 79.88 |
| Olive Oil | Poplin D65/C35 | 89.59 | 84.05 |
| Motor Oil | Poplin D65/C35 | 72.88 | 72.36 |
| Lard | Poplin D65/C35 | 85.02 | 78.83 |
| Chicken Fat | Cotton Percale | 81.63 | 78.89 |
| Total L* | | 809.09 | 778.90 |

As demonstrated in the Table, the detergency provided by Composition V containing an ether quat having a low degree of ethoxylation, and hence outside the invention, was significantly below that provided by the comparative composition S1 which was identical in composition to Composition V except S1 did not contain the ether quat of Composition V.

What is claimed is:

1. A stable structured liquid laundry detergent composition which is particularly effective for removing oily soils from fabrics comprising, by weight:

(a) from about 10% to about 20% of a linear alkyl benzene sulfonate anionic surfactant;

(b) from about 1% to about 10% of an alkyl ether sulfate anionic surfactant;

(c) from about 5% to about 30% of an alkali metal phosphorous-containing builder;

(d) from about 2% to about 15% of sodium carbonate; the total amount of components (c) plus (d) in the detergent composition being at least about 10%;

(e) from about 0.1% to about 5% of an ethoxylated amine quaternary cationic surfactant having the following structural formula:

(1)

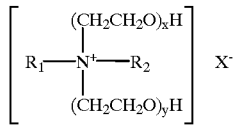

wherein $R_1$ represents a linear branched or substituted $C_8$–$C_{18}$ alkyl, alkaryl, aryl, alkenyl or ether moiety; $R_2$ represents an alkyl group containing from 1 to 3 carbon atoms or a benzyl group; each of x and y are integers which can vary independently from 1 to 8 and the sum of x plus y is greater than 2 and less than 9; and X represents a water-soluble anion; and (f) balance water, said structured liquid detergent composition being free of a nonionic surfactant, and wherein the respective amounts of each of the components (a) through (e) is selected to provide a stable structured liquid composition.

2. A stable structured liquid detergent composition in accordance with claim 1 wherein said phosphorous-containing builder is sodium tripolyphosphate.

3. A stable structured liquid detergent composition in accordance with claim 1 wherein said ethoxylated amine quaternary cationic surfactant is isodecyloxypropyl poly(5) oxyethylene methyl chloride quat (Iso $C_{10}$ oxypropyl).

4. A stable structured liquid detergent composition in accordance with claim 1 wherein said ethoxylated amine quaternary cationic surfactant is isotridecyloxypropyl poly (5) oxyethylene methyl chloride quat (Iso $C_{13}$ oxypropyl).

5. A stable structured liquid detergent composition in accordance with claim 1 wherein said ethoxylated amine quaternary cationic surfactant is present in an amount from about 0.5% to about 3.0%, by weight.

6. A method for laundering soiled and/or stained fabrics comprising (a) forming an aqueous wash solution or wash bath containing a cleaning effective amount of the structured liquid laundry detergent composition defined in claim 1; and (b) subjecting the fabrics to be laundered to a washing action in said wash solution or wash bath.

7. A method for laundering in accordance with claim 6 wherein said structured liquid detergent composition is present in said wash solution or wash bath in an amount of from about 1 gram/liter to about 2.5 gram/liter.

8. A method for laundering in accordance with claim 6 wherein the cationic surfactant in said liquid detergent composition is isodecyloxypropyl poly(5) oxyethylene methyl chloride quat (Iso $C_{10}$ oxypropyl).

9. A method for laundering in accordance with claim 6 wherein the cationic surfactant in said structured liquid detergent is ethoxylated amine quaternary cationic surfactant is isotridecyloxypropyl poly(5) oxyethylene methyl chloride quat (Iso $C_{13}$ oxypropyl).

* * * * *